US005692273A

United States Patent [19]

Rodde

[11] Patent Number: 5,692,273

[45] Date of Patent: Dec. 2, 1997

[54] DEVICE FOR CONNECTING A WINDOW TO A WINDOW LIFTER

[75] Inventor: Thomas Rodde, Coburg, Germany

[73] Assignee: Brose Fahrzeugteile GmbH & Co. KG, Coburg, Germany

[21] Appl. No.: 504,531

[22] Filed: Jul. 20, 1995

[30] Foreign Application Priority Data

Jul. 28, 1994 [DE] Germany ..... 44 26 670.7

[51] Int. Cl.[6] ..... A44B 21/00; E05F 11/00

[52] U.S. Cl. ..... 24/541; 24/542; 49/375

[58] Field of Search ..... 24/541, 542, 543, 24/540, 530; 49/375, 227

[56] References Cited

U.S. PATENT DOCUMENTS

| | | | |
|---|---|---|---|
| 1,080,336 | 12/1913 | Gammelgaard | 24/541 |
| 1,624,253 | 4/1927 | Kilby | 24/541 |
| 2,165,216 | 7/1939 | Boots | 24/541 |
| 2,200,340 | 5/1940 | Painter | 24/541 |
| 3,026,592 | 3/1962 | Dudley | 24/541 |
| 3,137,027 | 6/1964 | Birkle | 24/542 |
| 3,754,353 | 8/1973 | Breitschwerdt et al. | 49/375 |
| 5,337,987 | 8/1994 | Sawatsky | 24/543 |
| 5,384,935 | 1/1995 | Maier-Hunke et al. | 24/67 R |

FOREIGN PATENT DOCUMENTS

| | | |
|---|---|---|
| 208237 | 1/1987 | European Pat. Off. . |
| 3108244 | 6/1982 | Germany . |
| 3817260 | 11/1989 | Germany . |
| 4218425 | 12/1993 | Germany . |
| 473987 | 7/1969 | Switzerland . |

*Primary Examiner*—Victor N. Sakran
*Attorney, Agent, or Firm*—Christie, Parker & Hale, LLP

[57] ABSTRACT

The invention relates to a device for connecting a window to a window lifter and is distinguished by a simple design, using only a few component parts. In addition, the invention guarantees a simple assembly process. It is characterized in that the gripping jaws can be loaded toward the window by a spring element. According to one preferred variant, the gripping jaws (11, 11*a*, 11*b*, 12, 12*a*, 12*b*) *are connected to an essentially U-shaped spring clasp* (2, 2*a*, 2*b*). *Between at least one gripping jaw* (12, 12*a*, 12*b*) *and one end of the spring clasp* (2, 2*a*, 2*b*), *a tension lever* (4, 4*a*), *a tension cam* (4*b*), *or the like is disposed, which in its tensed position presses the ends of the spring clasp* (2, 2*a*, 2*b*) *apart and as a result, produces the gripping power.*

11 Claims, 8 Drawing Sheets

DEVICE FOR CONNECTING A WINDOW TO A WINDOW LIFTER

FIELD OF THE INVENTION

This invention relates to a device for connecting a window to a window lifter, and an assembly process therefor.

BACKGROUND OF THE INVENTION

There are various types of devices known for connecting a window to a window lifter. In principle, distinctions are made between positive-fit, that is snappable connections, non-positive clamp connections, and adhesive connections.

EP 0 208 237 B1 discloses a carrier element for connecting the window to a corresponding guide device, which has several support wings disposed on both sides of the lower edge of the window. One of the support wings has a pin, which is associated with a hole in the window. Upon insertion of the window between the deformable support wings, the pin is inserted into the window hole.

In the assembly process, however, alignment between the window hole and the pin to be inserted therein is difficult to achieve. Due to manufacturing tolerance limitations and in order to guarantee a reliable engagement, a certain excess amount of space must be provided between the pin and the base body, against which the lower edge of the window stops. As a result, an undesirable play is introduced, which can lead to noises, particularly when the movement direction of the window is reversed. Furthermore, due to its complex design, the manufacture of the described carrier is relatively costly.

DE 31 08 244 A1 shows a further snappable coupling device between a window and window lifter. It consists of two channels connected to each other. One channel encloses a lower edge of the window and fastens the window in the channels. The other channel, which opens downwards, has hooks directed inward on its ends, which engage projecting parts of angle elements of the lifter device, to achieve a positive fit connection. The connections of the device are completed when the window is forced against the upper stop position. The automatic alignment of the window in the frame structure is simultaneously achieved with the connection, and no additional manipulations are needed during assembly.

However, since the channel coupling element on the lower edge of the window must be preassembled, the thickness increase occurring with the preassembly usually leads to a more difficult insertion of the window into the door shaft. Because of the necessary lack of seals in this region, the paint is frequently damaged during assembly. The low tolerances required in the snap region of the coupling elements presents an additional problem when attempting to prevent noises during operation of the window lifter when reversing direction.

DE 42 18 425 A1 shows a typical non-positive clamp connection between a window and a window lifter. In it, the window is clamped between two rubber-covered protrusions; the gripping or tensing power is produced by a screw connection on top of a support between the two protrusions.

This connection has the advantage that the window can be inserted into the door shaft without trouble even if the window seals are already installed in the door shaft. However, the large number of parts comprising the device is disadvantageous.

DE 38 17 260 C2 discloses a lifter rail fastened into the lower edge of the window with an adhesive. Once again, it has to be installed outside the door.

BRIEF SUMMARY OF THE INVENTION

One embodiment of the invention provides a spring element, with which the gripping jaws of a device for connecting a window to a window lifter can be loaded toward the surface of a window. Tension elements can be used to tension the spring element, to create the required gripping power after insertion of the window between the gripping jaws. The force configuration present after the spring element is tensioned, locks the tension element in the tensioned state.

In another embodiment, it is also possible to store the gripping power in the spring element prior to insertion of the window between the gripping jaws. After the window is inserted between the gripping jaws, the gripping power is released by actuating a release. The gripping jaws then press onto the surface of the window. This release is triggered by the window itself, in particular by the lower edge of the window.

Advantages of this invention will appear from the following Detailed Description and the accompanying drawings in which similar reference characters denote similar elements throughout the several views.

DETAILED DESCRIPTION

FIGS. 1–3*e* show multiple embodiments of the invention using a separate resilient element, which can be tensioned by a tension element, and which transfers spring tension, to gripping jaws thereby supporting a window.

Figure 1:
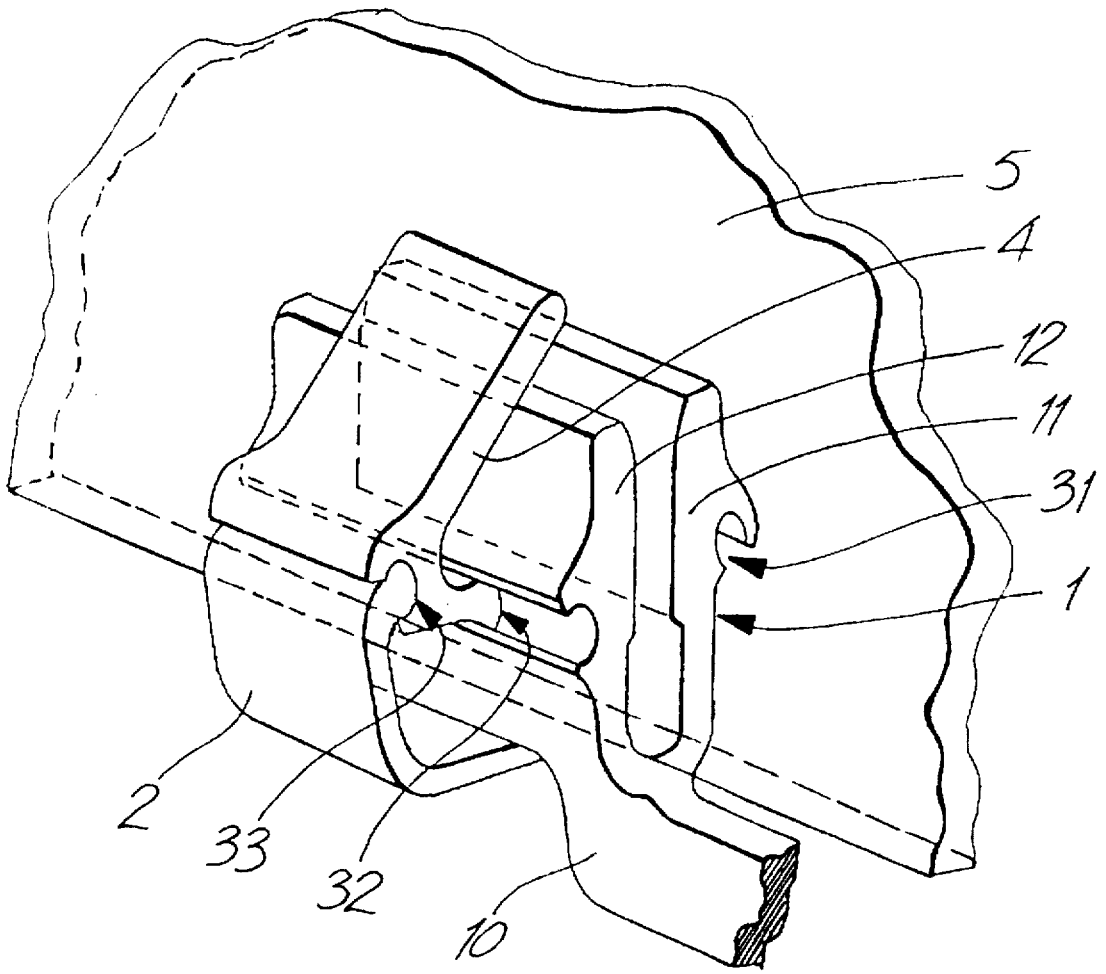
FIG. 1 shows a perspective representation of the device with separate spring clasp and lever, in the tensioned position.

An exemplary embodiment shown in FIG. 1 uses a U-shaped window retainer 1, which has two legs and opens toward the top. Upper sealing regions, which are oriented toward a window 5, include gripping jaws 11, 12 which terminate in insertion slants 8. The insertion slants provide a wide opening for receiving the window 5 into the gap between the gripping jaws. In the lower region, an extension 10 connects the window retainer 1 to the mechanism of the window lifter (not shown). A lever 4 is pivotally connected to the free end of a resilient element or spring clasp 2 and serves as a tension element. The lever is operatively interposed between the resilient element and gripping jaws, so that the lever deforms the resilient element. The resilient element operatively communicates with the gripping jaws to squeeze the gripping jaws inwardly on the window as it is deformed. The short free end of the lever 4 is pivotally jointed to the leg of the window retainer 1. On the opposite side of the window retainer 1, the other end of the spring clasp 2 is pivotally supported in the jaw 11. All joints 31, 32, 33 are ball-and-socket type joints. The ball-and socket joints help to reduce the force applied to the lever which is necessary to clamp the window in place. The balls are clippable out of the sockets so that the device is easy to construct and handle.

Figure 1C:
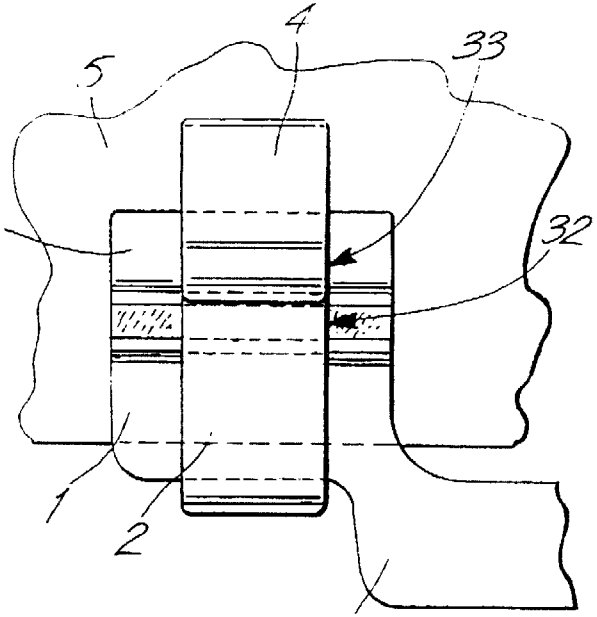
FIG. 1*c* shows a side view of the device of FIG. 1*b;*
Figure 1B:
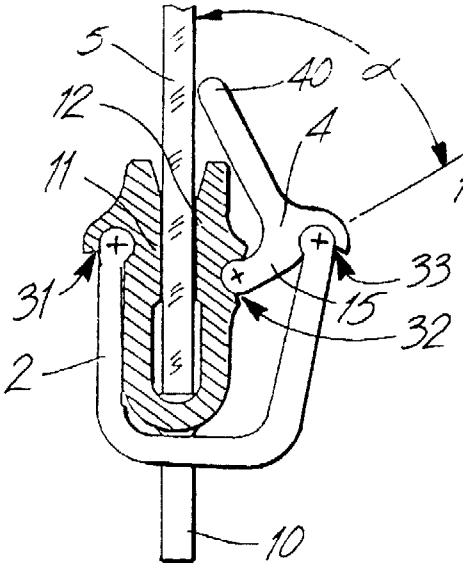
FIG. 1*b* shows a cross section through the device of FIG. 1, in the tensioned state.
Figure 1A:
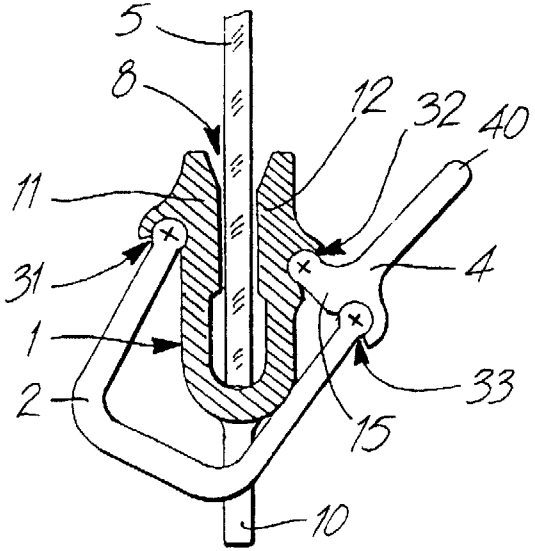
FIG. 1*a* shows a cross section through the device of FIG. 1, in the non-tensioned state.

While FIG. 1*b* and 1*c* show the lever 4 in the tensioned position, FIG. 1*a* shows the lever in a non-tensioned position. In this position, the gap between the gripping jaws 11, 12, which adjoins the insertion slants 8, is slightly larger than the thickness of the window 5. By pivoting the free end 40 of the lever 4 toward the window 5, the legs of the U-shaped spring clasp 2 are spread, and as a result, the gripping power required for fastening the window is produced, which is transferred to the gripping jaws 11, 12 pressing the gripping jaws against the surface of the window. The maximal gripping power is obtained, when the lever arm between the joints 32 and 33 produces the greatest spreading of the spring clasp 2. This occurs when the lever arm 15 connecting the joints 32, 33 of the lever is perpendicular relative to the window. After the lever arm passes perpendicular, it contacts a stop, which is the window in this embodiment, and the angle $\alpha$ between the axis of the lever arm and the axis of the window is acute. At this point, the joint 33 between the spring clasp and the lever is oriented farther away from the lower region of the window retainer then the joint 32 between the lever and the window retainer. Thus, an actuating force applied to the lever 4 forces the lever into a statically stable position (see FIG. 1*b*). The force created by bending the spring clasp not only pushes the gripping jaws toward each other, the force also pushes down on the joint 32 between the lever and the gripping jaw of the window retainer. Therefore, the force pushes the lever toward the statically stable position to provide a means for locking the device, and a spontaneous release of the connection does not occur. Because a spontaneous release cannot occur, a separate mechanism to prevent release is not required.

Figure 2C:
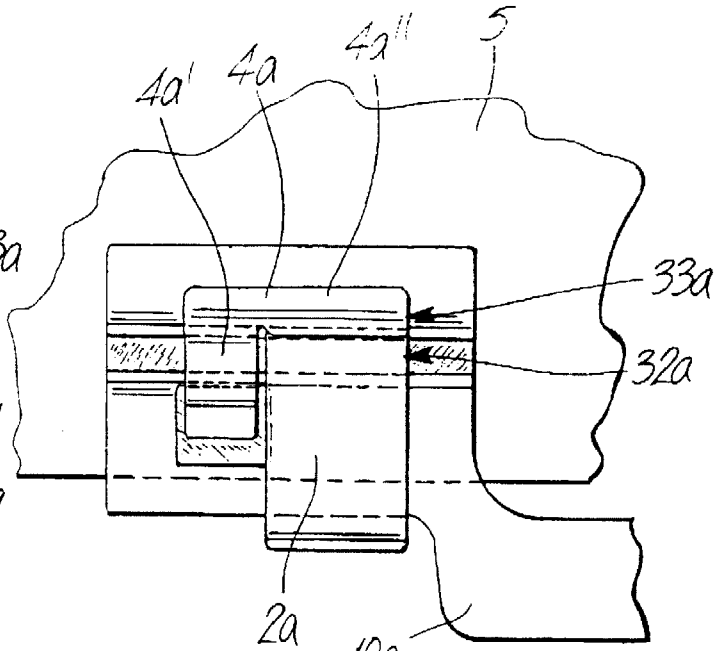
FIG. 2*c* shows a side view of the device of FIG. 2*b;*
Figure 2B:
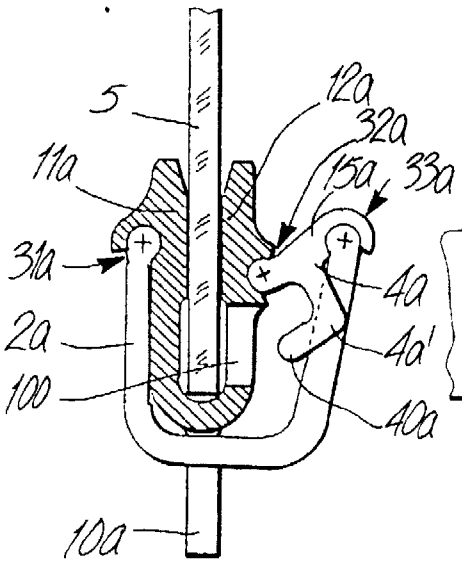
FIG. 2*b* shows the device of FIG. 2*a* in the tensioned state.
Figure 2A:
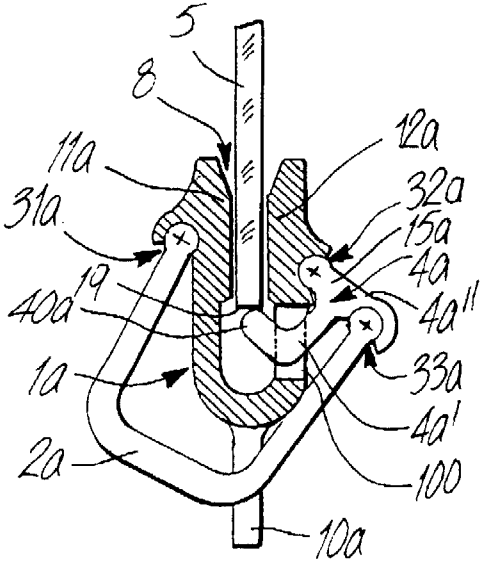
FIG. 2*a* shows a cross section through a device with separate spring clasp and lever, which engages in the gap between the gripping jaws, in the non-tensioned state.

FIGS. 2*a*–2*c* show an embodiment, which is very similar to the above described exemplary embodiment. It differs in the structure of the lever 4*a* and the interaction of the lever with the lower edge of the window 5. In the non-tensioned state, the actuating free end 40*a* of the articulated lever 4*a* extends into the inner region of the window retainer 1*a* by means of an opening 100 in the leg of the window retainer. Upon insertion of the window 5 into the gap between the gripping jaws 11*a*, 12*a*, the lower edge 19 of the window engages the free end 40*a* of the lever. With the progressive lowering of the window 5, the lever 4*a* is pivoted around the joint 32*a* between the lever and the window retainer 1*a* until it automatically snaps into the statically stable position shown in FIG. 2*b*. The lever automatically snaps into the stable position after the lever passes a dead center point. The dead center point is the point where the lever arm 15*a* connecting the joints 32*a*, 33*a* of the lever is perpendicular to the window. This is also the point of maximal gripping power. Similar to the embodiment of FIGS. 1*a*–1*c*, there is a downward force component on the joint 32*a* between the lever and the window retainer. The downward force causes the lever to stay in the stable position, and it performs the automatic snapping function just described. Thus, the lower edge of the window pushes the lever past the maximum gripping point after which the forces from the resilient spring clasp push the lever into the stable locked position.

This embodiment has the advantage of automatic fastening. For example, the fastening can take place during the first insertion of the window 5 into the sealing region. This feature also provides the additional advantage of an ideal window alignment.

Figure 3A:
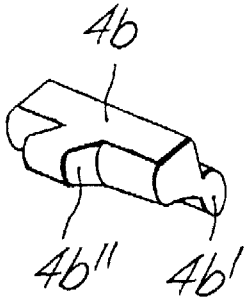
FIG. 3*a* shows the tension cam.
Figure 3B:
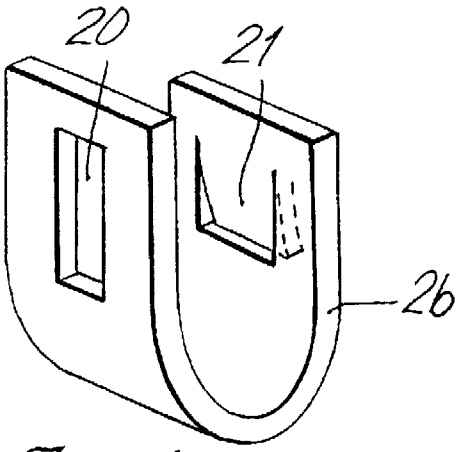
FIG. 3*b* shows the spring clasp.
Figure 3:
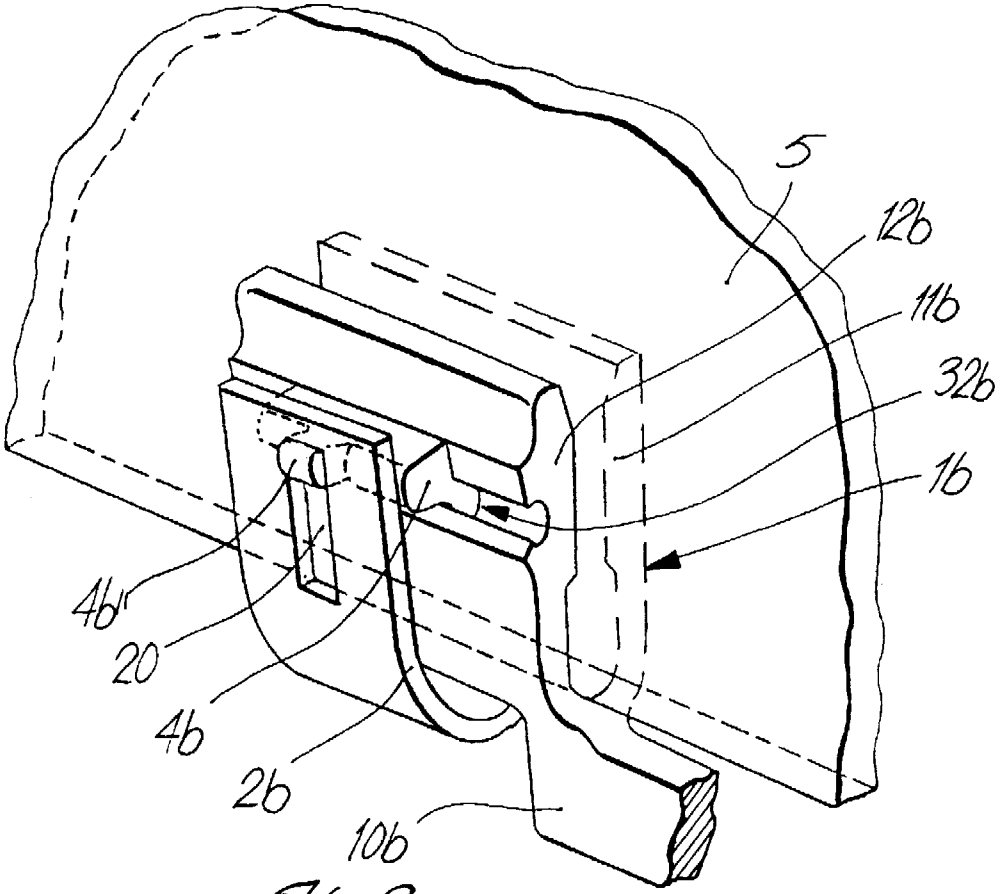
FIG. 3 shows a perspective representation of the device with separate spring clasp and a tension cam, which can pivot between two stops.
Figure 3E:
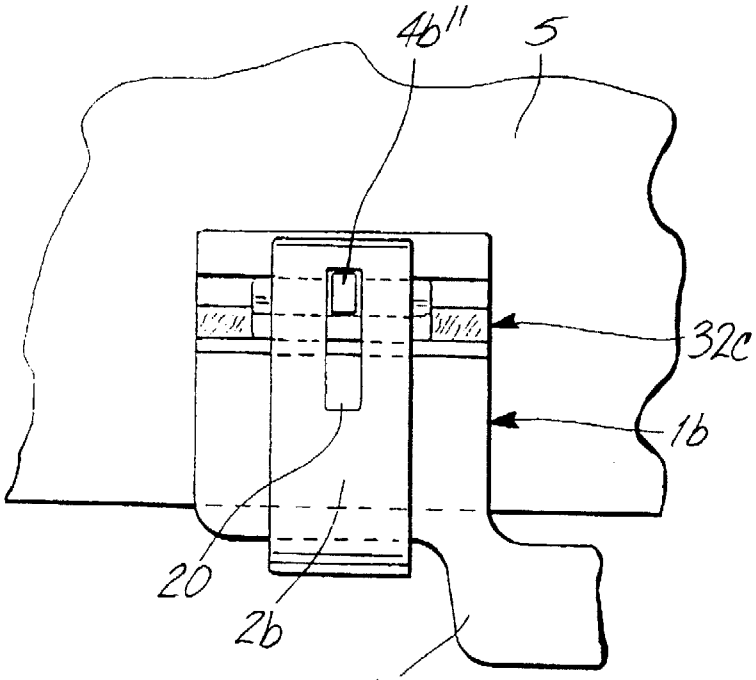
FIG. 3*e* shows a side view of the device of FIG. 3*d;*

The embodiment shown in FIGS. 3–3*e* represents a modification of the already described structural principle. An outer region of the window retainer 1*b*, which is disposed opposite the gripping jaw 11*b*, has a connecting region 1*b*' with an inside projection 17. The inside projection serves to fasten a spring hook 21 of the spring clasp 26 onto the inside projection 17 of the connecting region 1*b*' in the assembled state. Thus, the spring hook and projection assembly forms a spring latch connection. On the opposite side or inner region, the spring clasp 2*b* has a slide way 20, which is the shape of an elongated opening 20, in which the nose 4*b*" of a tension lever 4*b* is stably attached. The joining region 4*b*' of the tension lever is rotatably joined to the window retainer with a ball-and-socket joint 32*c*.

Figure 3D:
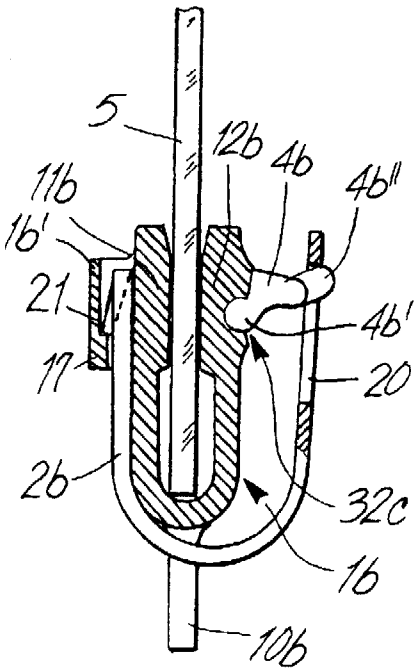
FIG. 3*d* shows a cross section through the device of FIG. 3, in the tensioned state.
Figure 3C:
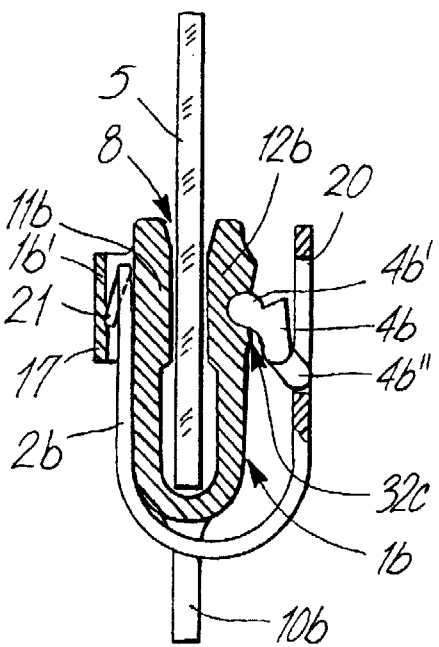
FIG. 3*c* shows a cross section through the device of FIG. 3, in the non-tensioned state.

FIG. 3*c* shows the position of the tension cam 4*b* in the non-tensioned state. In order to put the device in tension, the lever 4*b* is slid by an actuating force placed against the lever with a special auxiliary tool into the upper stop position, where the lever 4*b* reaches its statically stable position. The tensioned position is shown in FIGS. 3, 3*d*, and 3*e*. The lever 4*b* is held in the stable position by the same force configuration as the embodiments of FIGS. 1 and 2*a*.

The embodiments shown in FIGS. 4*a*–6*d* employ a structural principle different from the above described structures. In these embodiments, the functions of the window retainer and spring clasp are combined into one functional unit. The window retainer functions simultaneously as the resilient element (spring clasp), which exerts the clamping force.

Figure 4C:
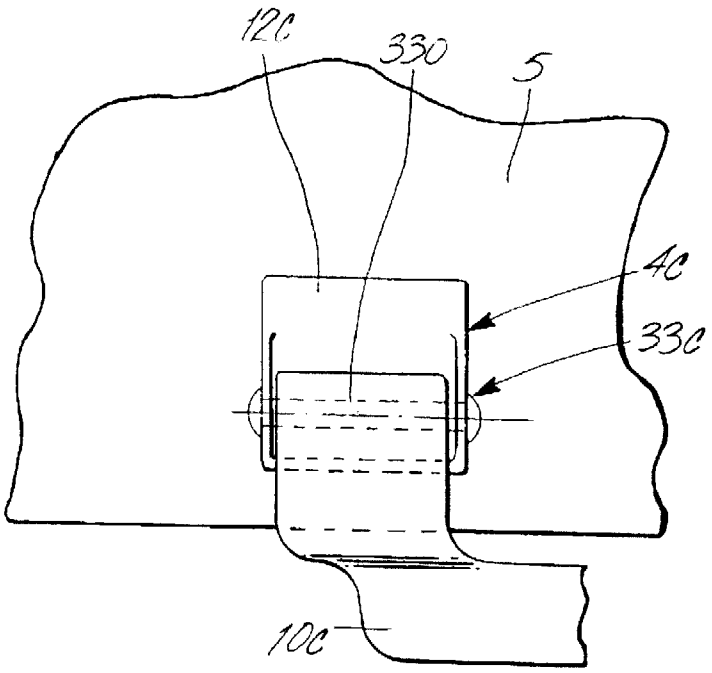
FIG. 4*c* shows a side view through the device according to FIG. 4*b;*
Figure 4B:
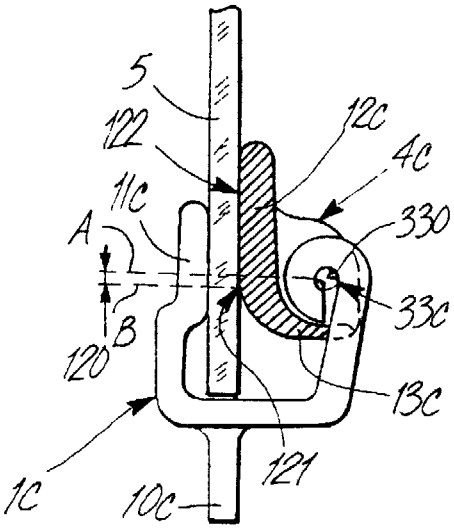
FIG. 4*b* shows the device of FIG. 4*a*, but in the tensioned state.
Figure 4A:
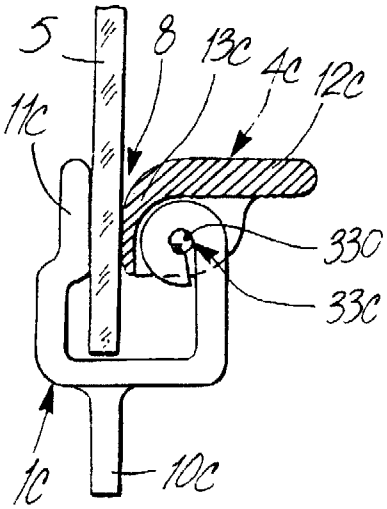
FIG. 4*a* shows a cross section through a device with a one-piece window retainer, comprising a spring clasp and a pivotable tension cam in the non-tensioned state.

FIGS. 4*a*–4*c* show different views of a device according to the invention with a one-piece window retainer 1*c* also functioning as a resilient spring clasp. Also, the window retainer is essentially U-shaped and has at its lower region an extension 10*c*, which is connected to the mechanism of the window lifter (not shown). One of the free legs of the window retainer 1*c* is a gripping jaw 11*c*. The end of the other leg constitutes a joint 33*c*, through which a pin 330 is passed. The pin pivotally supports a tension cam 4*c* at the pivot point defined by the pivot pin 330.

FIG. 4*a* shows the tension cam 4*c* in the position in which the window 5 can be inserted into the window retainer 1*c*. The guide clamp or insert jaw 13*c* extends from the joint 33*c* to a distance which allows the window 5 to be inserted into the window retainer. A gripping jaw 12*c* of the tension cam extends at an angle from the guide clamp 13*c* and extends a greater distance from the pivot point defined by the pivot pin 330. The gripping jaw 12*c* and guide clamp 13*c* are joined to each other via a curved region. If an actuation force is exerted on the free end of the gripping jaw 12*c* so that the tension cam 4*c* with its gripping jaw 12*c* pivots toward the window 5 as shown in FIG. 4*b* and 4*c*, then the legs of the window retainer 1*c* are spread because the gripping jaw 12*c* which extends farther away from the pivot point is interposed between the joint 33*c* and the window. This elastic deforming produces the gripping power necessary to fasten the window in the between the gripping jaws.

The tension cam 12*c*, just as the above described lever, locks in the tensioned position. The pivot axis of the pin 330 of the joint 33*c* should be disposed above at least part of a bearing face or surface 122 between the gripping jaw 12*c* of the tension cam and the window 5. The bearing face is the area of contact between the gripping jaw 12*c* of the tension cam and the window. Put another way, an imaginary line A drawn from the pivot axis to the window should intersect a central portion of the bearing surface. Thus, the bearing surface is in a balanced positive relative to the pivot axis. The greater the space 120, illustrated by the imaginary lines A and B, between the pivot axis of the joint 33*c* and the lower edge 121 of the bearing face 122 of the gripping jaw 12*c*, the more stable the tensioned position of the tension cam 4*c*. This is true because the force between the window and gripping jaw above the pin 330 creates a moment around the pin 330 which must be counter acted to stabilize the tension cam in the tensioned positioned, and the force between the window and gripping jaw below the pin, in addition to friction on the bearing surface, creates a counter balancing moment. Thus, the greater the space 120, the closer the counter balancing moment comes to balancing the moment created by the forces above the pin.

Figure 5C:
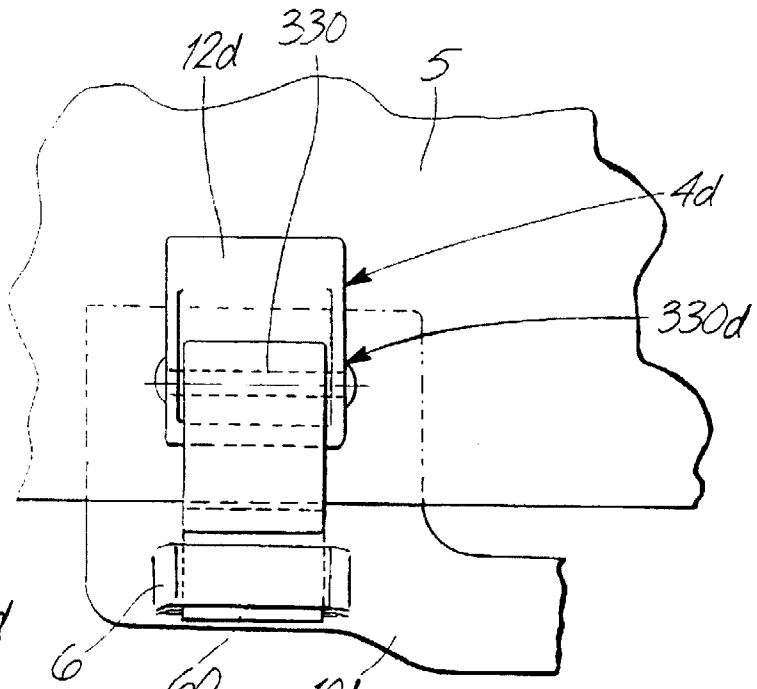
FIG. 5*c* shows a side view of the device of FIG. 5*b;*
Figure 5B:
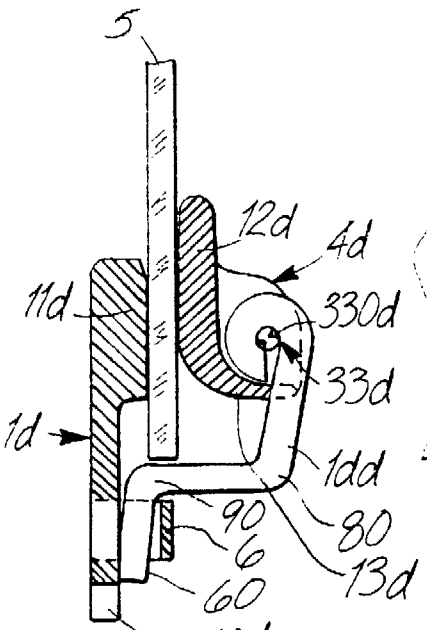
FIG. 5*b* shows the device of FIG. 5*a* in the tensioned state.
Figure 5A:
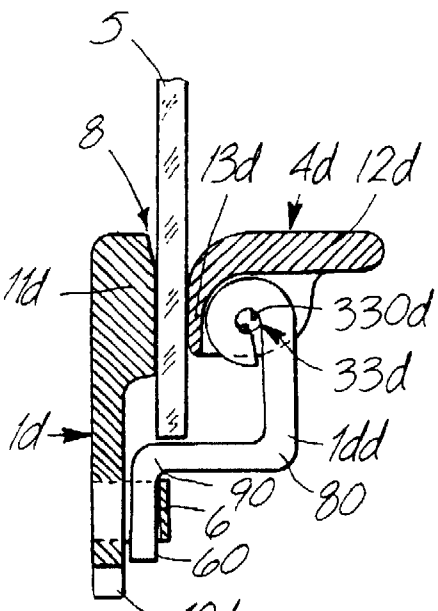
FIG. 5*a* shows a cross section through a device with a two-piece window retainer, comprising a spring clasp and a pivotable tension cam in the non-tensioned state.

The embodiment shown in FIGS. 5*a*–5*c* has a two-piece window retainer 1*d*. Although the number of parts of the device is increased, there is a concomitant advantage from using simpler parts. Further, the two-piece assembly allows a reduction in width of the device which coincides with the current trend toward more narrow vehicle doors. The leg 1*d* of the window retainer is relatively sturdy and rigid. Its upper region functions as a gripping jaw 11*d* . The window facing side of the free end of the gripping jaw, terminates in a bevel. The bevel, together with the curved transition region between the insert jaw 13*d* and the gripping jaw 12*d* of the tension cam 4*d*, constitute the insertion slants 8 for the window 5. The lower end of the leg 1*d* terminates in the extension 10*d*, which is connected to the mechanism of a window lifter (not shown). The other leg 1*dd* of the window retainer is a spring leg which has two angles 80, 90. The lower, free clamp end 60 of the spring leg 1*dd* is inserted into a spring bracket 6 in a plug like fashion.

When an actuation force is applied to the gripping jaw 12*d*, the tension cam 4*d* rotates on the pin 330*d* until the gripping jaw 12*d* engages the window as shown in FIGS. 5*b* and 5*c*. Because the gripping jaw 12*d* extends a greater distance away from the pivot pin 330*d* than the insert jaw 13*d*, the engagement of the window by the gripping jaw 12*d* causes the angles 80, 90 of the spring leg 1*dd* to elastically deform as illustrated in FIG. 5*b*. The deformation of the angles causes the window to be squeezed between the gripping jaws 11*d*, 12*d* thereby gripping the window.

The embodiment of the invention shown in FIGS. 6*a*–6*d* also has a two-piece design of the window retainer, but it differs in the manner in which the spring force (clamping force) is produced. In the above embodiments the window 5 was inserted between the non-tensioned gripping jaws of the window retainer. The tension element was then actuated either by the insertion of the window or an externally applied actuating force to produce the clamping force. The clamping force in the device of FIG. 6 is already stored before the window 5 is inserted into the window retainer 1*e*.

When the leg 1*e* and the spring leg lee are assembled by inserting the clamping end 60*e* of the spring leg 1*ee* into the spring bracket 6*e*, the window retainer is in a tensionless state. In the tensionless state, the gripping jaws 11*e*, 12*e* have a gap between them that is narrower than the thickness of the window 5. Thus, the spring leg and window retainer are predisposed to a position in which the gap between the gripping jaws is smaller than the thickness of the window, and therefore, once the window is in place, the device is stable in the tensioned position. Then a rigid u-shaped spacer element 7 is inserted between the gripping jaws 11*e*, 12*e* of the legs 1*e*, 1*ee*, which spreads the legs 1*e*, 1*ee* and widens the gap to a width which is greater than the thickness of the window. To stabilize the position of the spacer element 7, and thereby assure the gap is large enough to receive the window, grooves 71 are provided below the gripping jaws 11*e*, 12*e*, in which knobs 70 of the spacer element 7 removably settle.

Figure 6D:
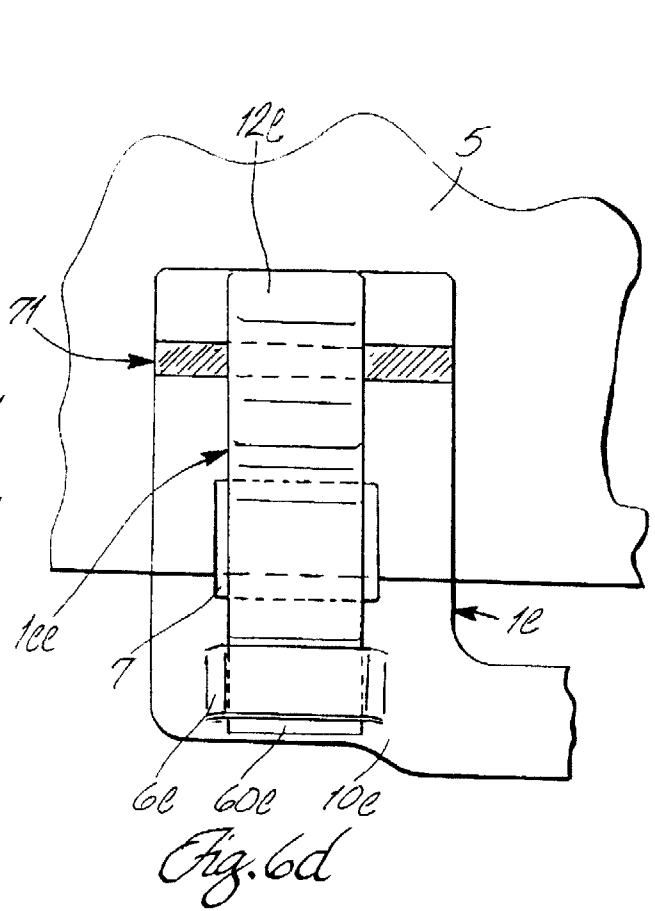
FIG. 6*d* shows a side view of the device of FIG. 6*c*.
Figure 6C:
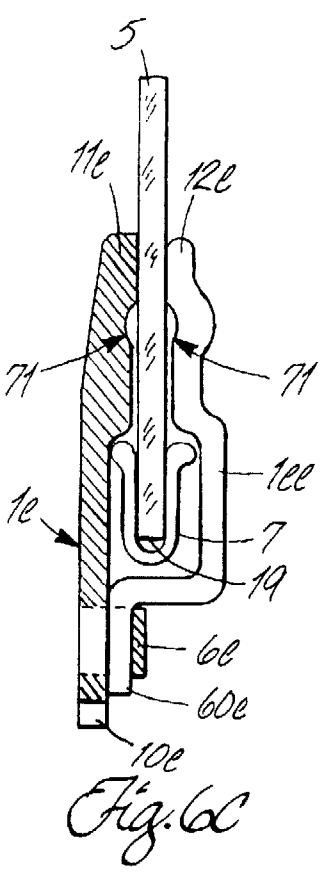
FIG. 6*c* shows the device of FIG. 6*a* in the assembled state.
Figure 6B:
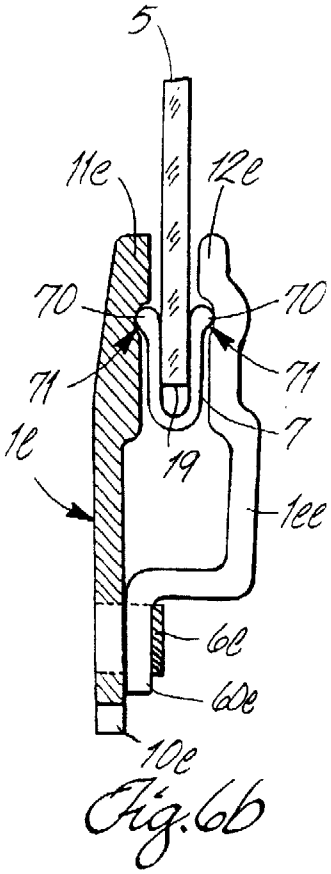
FIG. 6*b* shows the device of FIG. 6*a*, with the window engaging the spacer element on the inside of the window retainer.
Figure 6A:
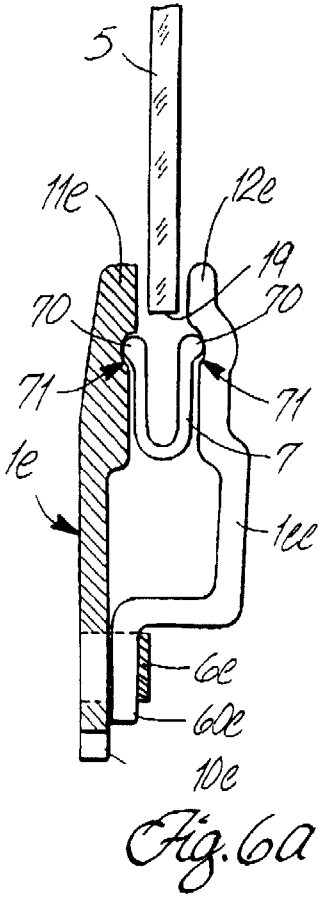
FIG. 6*a* shows a cross section through a device with a two-piece window retainer comprising a spring clasp, and a spacer element for releasing the stored spring tension, in the pretensioned state before insertion of the window.

As illustrated in FIG. 6*a*, the window 5 is then inserted into the window retainer. Upon further penetration, the lower edge of the window engages the spacer element 7 (see FIG. 6*b*) and forces the knobs 70 out of the grooves 71. When the spacer element 7 reaches the lower region of the window retainer as shown in FIG. 6*c*, the spaces no longer forces the legs 1*e*, 1*ee* apart, and the stored spring tension from pretensioning the gripping jaws causes the pressing contact of the gripping jaws 11*e*, 12*e* on the surface of the window. This embodiment of the invention prevents an unintentional release of the connection between the window retainer and the window 5, and provides the advantage of automatic fastening.

The device according to the present invention for connecting a window to a window lifter is distinguished by a structurally simple design and ease of manufacture. No additional parts must be added before the window and device are inserted into the door shaft so the device is assembly-friendly. The device has the ability to be combined in a simple manner with other connecting techniques in order to produce a further increase in reliability of the connection. Some embodiments allow the connection between window and window lifter to be achieved automatically without additional assembly steps by a worker. Further, the individual parts making up the device can be manufactured by a machining process, extrusion, continuous casting, or other processes for producing endless, semifinished products.

Thus, a connecter for connecting a window to a window lifter is disclosed which utilizes a window retainer to grip the window and more efficiently connect the window to the window lifter mechanism. While embodiments and applications of this invention have been shown and described, it would be apparent to those skilled in the art that many more modifications are possible without departing from the inventive concepts herein. It is, therefore, to be understood that within the scope of the appended claims, this invention may be practiced otherwise then as specifically described.

The disclosure of attached German patent application P 44 26 670.7 filed Jul. 28, 1994, a copy of which is Exhibit A hereto, is incorporated fully herein by reference. Priority of this German application is claimed.

What is claimed is:

1. A connector which automatically connects a window to a window lifter comprising:

a window retainer coupled to the window lifter, the window retainer having first and second gripping jaws and a gap therebetween for insertion of the window;

a resilient element coupled to the first gripping jaw; and automatic actuating means in operative communication with the resilient element and the second gripping jaw for receiving the window during insertion of the window into the gap, thereby causing the resilient element to force the gripping jaws to grip the window.

2. The connector of claim 1 wherein the automatic actuating means comprises a lever operatively interposed between the second gripping jaw and the resilient element, the lever having an actuating free end extending through an opening in the window retainer and into the gap between the gripping jaws whereby the window being inserted into the gap engages the actuating free end to pivot the lever and cause the gripping jaws to press against the window.

3. The connector of claim 1 wherein a lower edge of the window engages the automatic actuating means whereby the automatic gripping of the window is initiated.

4. The connector of claim 1 wherein at least one of the first and second gripping jaws has an insertion slant on a face of the gripping jaw facing the gap whereby the window is more easily inserted into the gap.

5. The connector of claim 1 further comprising means for stably locking the gripping jaws against the window.

6. The connecter of claim 5 wherein the stable locking means comprises a lever operatively interposed between at least one gripping jaw and the resilient element, the lever having an arm connecting the gripping jaw to the resilient element, the arm having an axis intersecting an axis of the window at an acute angle whereby the force exerted on the arm by the resilient element pushes on the gripping jaw in a direction downward and toward the window thereby locking the lever in the position in which the gripping jaws are pressed against the window.

7. The connecter of claim 5 wherein the stable locking means comprises the resilient member having a predisposed untensioned position in which the gap between the gripping jaws is more narrow than a thickness of the window whereby the gripping jaws are locked in a position pressing against the window inserted in between the gripping jaws.

8. A connector which automatically connects a window to a window lifter comprising:

a window retainer coupled to a window lifter, the window retainer having first and second gripping jaws and a gap therebetween for insertion of the window, at least one of the gripping jaws being resilient; and automatic actuating means in operative combination with the first and second resilient gripping jaws for receiving the window during insertion of the window into the gap, thereby causing the first and second resilient gripping jaws to grip the window.

9. The connector of claim 8, wherein the automatic actuating means comprises a spacer in the gap between the first and second gripping jaws whereby the window being inserted into the gap engages the spacer and dislodges the spacer from between the gripping jaws whereby the gripping jaws are allowed to press against the window.

10. The connector of claim 8, wherein the spacer is u-shaped and has two legs, each leg having an end, each end having a knob removably settling into grooves in the gripping jaws.

11. The connector of claim 8, further comprising a means for stably pretensioning the gripping jaws to press against the window.

* * * * *